US006672910B2

(12) United States Patent
Hotea

(10) Patent No.: US 6,672,910 B2
(45) Date of Patent: Jan. 6, 2004

(54) CONTACT WITH AN IMPROVED LOCKING ELEMENT

(75) Inventor: Gheorghe Hotea, Griesheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/223,452

(22) Filed: Aug. 19, 2002

(65) Prior Publication Data

US 2003/0073354 A1 Apr. 17, 2003

(30) Foreign Application Priority Data

Aug. 30, 2001 (EP) ..... 01120857

(51) Int. Cl.[7] ..... H01R 13/187
(52) U.S. Cl. ..... 439/843
(58) Field of Search ..... 439/843–846, 439/595

(56) References Cited

U.S. PATENT DOCUMENTS 5,613,885 A * 3/1997 Plate et al. ..... 439/843
5,787,754 A * 8/1998 Carrion et al. ..... 72/407
5,951,338 A * 9/1999 Seko et al. ..... 439/843
6,132,264 A * 10/2000 Egenolf ..... 439/843
6,186,840 B1 * 2/2001 Geltsch et al. ..... 439/843

FOREIGN PATENT DOCUMENTS

DE 19533723 A1 3/1997
DE 20013570 U1 2/2001

* cited by examiner

*Primary Examiner*—Gary Paumen

(57) ABSTRACT

A contact having a contact spring, a contact positioner, and a locking element. The contact spring having resilient contacts. The contact positioner receives the contact spring for connection to an electrical conductor. The locking element has a guide face with a locking side that maintains the contact in a housing. A cover covers the locking side to form a closed surface. A guide plate is integrally formed with cover and covers the lateral side of the guide face to form a closed surface. The cover and guide plate enlarge a seal opening of the housing to prevent the seal from damage by the locking element when the contact is inserted and withdrawn from the housing.

20 Claims, 12 Drawing Sheets

CONTACT WITH AN IMPROVED LOCKING ELEMENT

BACKGROUND OF THE INVENTION

The invention relates to contacts for plug housings. More specifically, the invention relates to a contact having a locking element with a cover that prevents damage to a seal in a plug housing during insertion and removal of the contact.

DESCRIPTION OF THE PRIOR ART

Plug housings are commonly provided with seals that protect contacts that are received in the plug housings from unwanted moisture. The conventional plug housing is already equipped with the seal before insertion of the contact. The seal is provided with openings that allow the contact to pass through the seal and into a receiving region of the plug housing. The contact is guided through the opening of the seal during production of the plug housing. Known contacts have an inclined guide face with which the seal is raised or enlarged during insertion of the contact to prevent tearing or widening of the seal. One such plug housing having a seal is taught by DE 195 33 723 A1. A conventional contact is taught by Utility Model DE 200 13 570 U1.

If, however, the contact needs to be removed from the plug housing, the contact has to be withdrawn through the opening of the seal. The contact can not always be withdrawn from the plug housing without damaging the seal, because the contact is provided with a locking element which secures the contact in the receiving region of the housing that is constructed counter to the direction of withdraw. To prevent damage to the seal during withdraw, it is known to provide a guide element constructed in the form of a guide plate on the contact, as shown in the Utility Model DE 200 13 570 U1. The guide plate is arranged laterally with respect to the locking element and causes a one-sided raising of the seal. The locking element, however, has a relatively sharp edge region in the direction of withdraw owing to its thinly constructed material. Thus, despite the arrangement of the guide plate, withdrawal of the contact from the plug housing without a risk of damage to the seal is not always possible.

It is therefore desirable to develop a contact that that can be withdrawn from a plug housing without risk of damage to a seal provided in the plug housing.

SUMMARY OF THE INVENTION

The invention relates to a contact having a termination section for connection to an electrical conductor. A contact section for contacting a complementary contact. A locking element having a guide face with a locking side for maintaining the contact in a housing and a cover that covers the locking side to form a closed surface.

DETAILED DESCRIPTION OF THE PREFERRED EMBODIMENT

Figure 1:
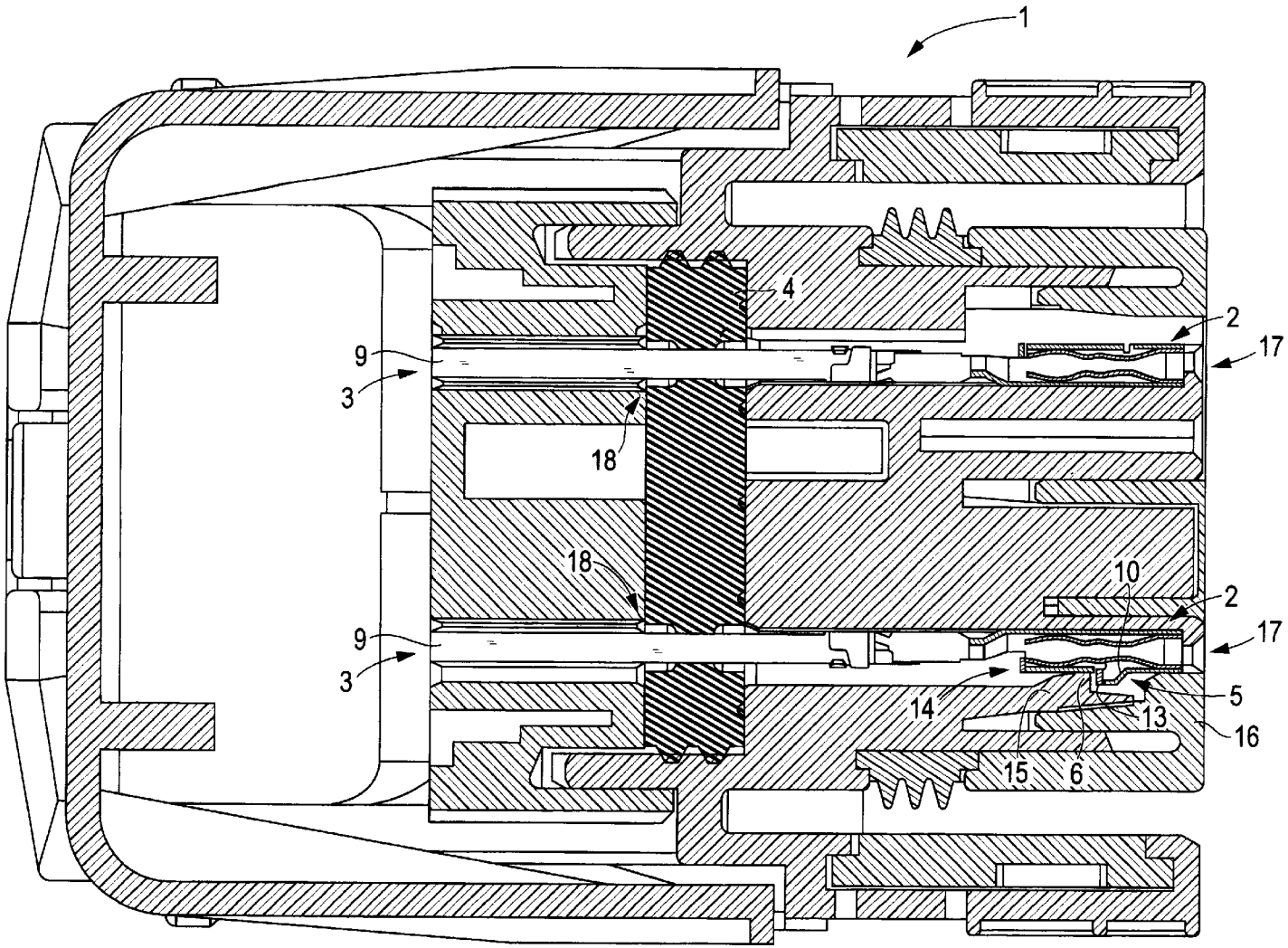
FIG. 1 shows a cross-section through a plug housing.

FIG. 1 shows a cross-section of a plug housing 1 having contacts 2 arranged in a connecting position and attached to an electrical connector 9. The housing 1 has a retaining edge 6 formed on an elastic web 15 held by a retaining part 16. The retaining edge 6 projects into a receiving space 14. Pluggable openings 17 are formed on a front face of the housing 1. Substantially opposite from the pluggable openings 17 is an insertion opening 3. A seal 4, constructed in this embodiment as a collective seal and comprising openings 18 for a plurality of electrical conductors 9, is formed between the insertion opening 3 and the receiving space 14.

Figure 2:
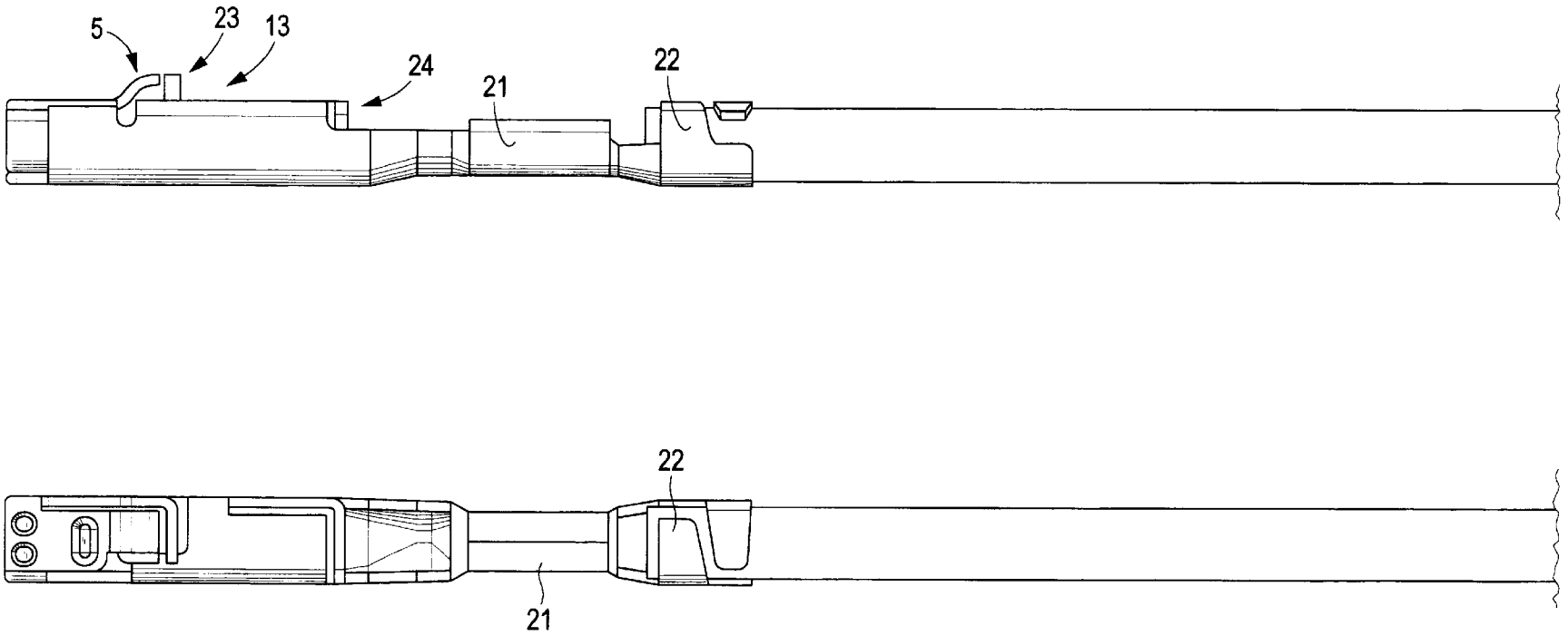
FIG. 2 shows a side view and a top view of an electrical conductor connected to a contact.

As shown in FIGS. 1 and 2, the contact 2 has a locking element 5 with a locking side 13. The locking element 5 is formed from a punched, cut or stamped plate. The plate has an edge on the locking side 13. Simple and inexpensive production of the locking element is possible in this manner. The locking side 13 has a first step 23 and a second step 24 by which the height of the contact 2 increases in a staggered manner. The first step 23 is formed on the locking side 13 of the locking element 5. The first step 23 serves to secure the contact 2 in a connecting position, as shown in FIG. 1. The second step 24 corresponds to the geometry selected for the connection of plug contacts inserted in the pluggable openings 17 in the contact section on the front part of the housing 1.

As shown in FIGS. 1 and 2, the contact 2 is connected to the electrical conductor 9. In this embodiment, the electrical conductor 9 is constructed as a wire with electric insulation. The wire is guided up to a termination section 21 of the contact 2. The electric insulation is secured to the contact 2 by retaining lugs 22.

Figure 3:
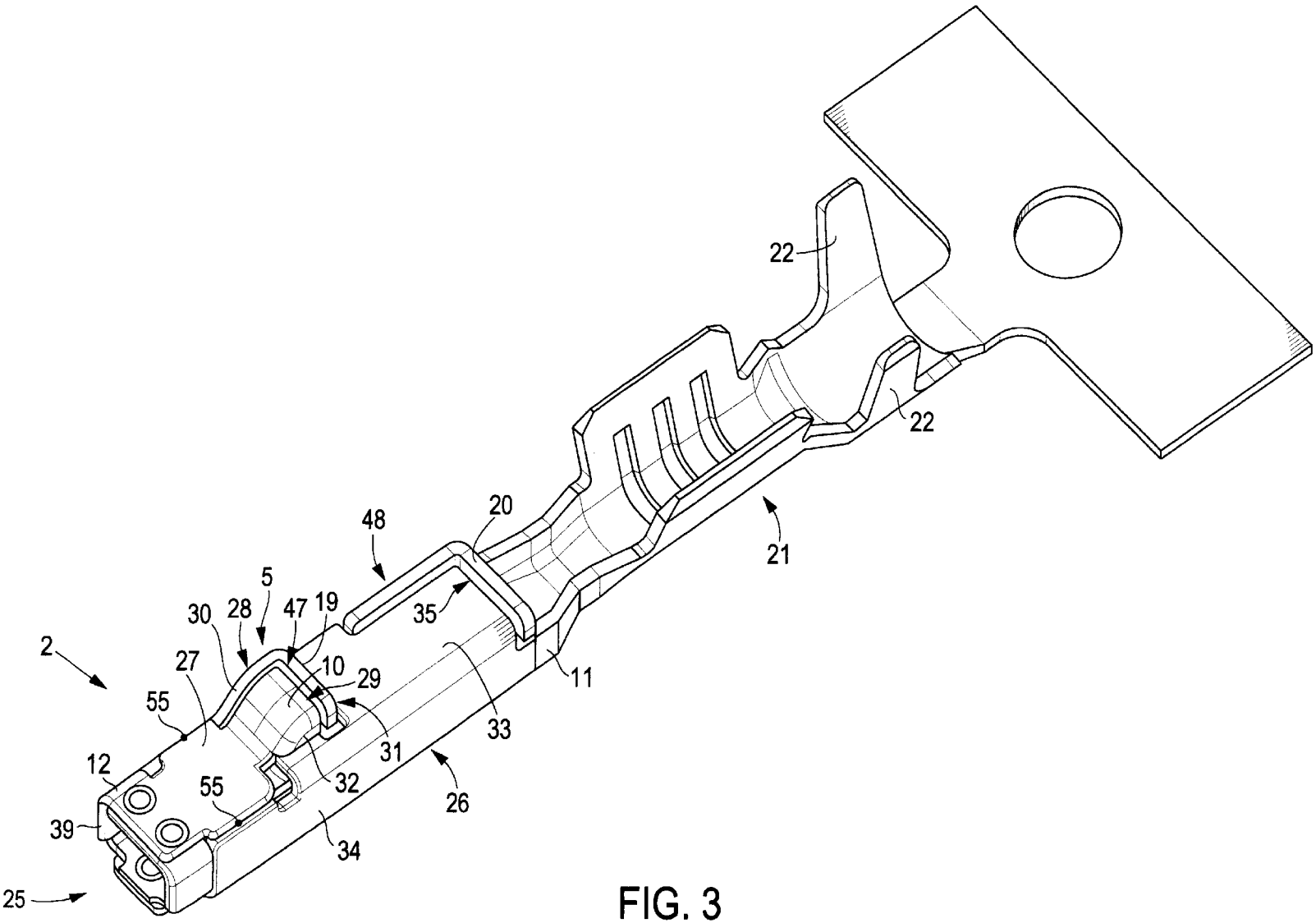
FIG. 3 shows a perspective view of a first embodiment of a contact.
Figure 5:
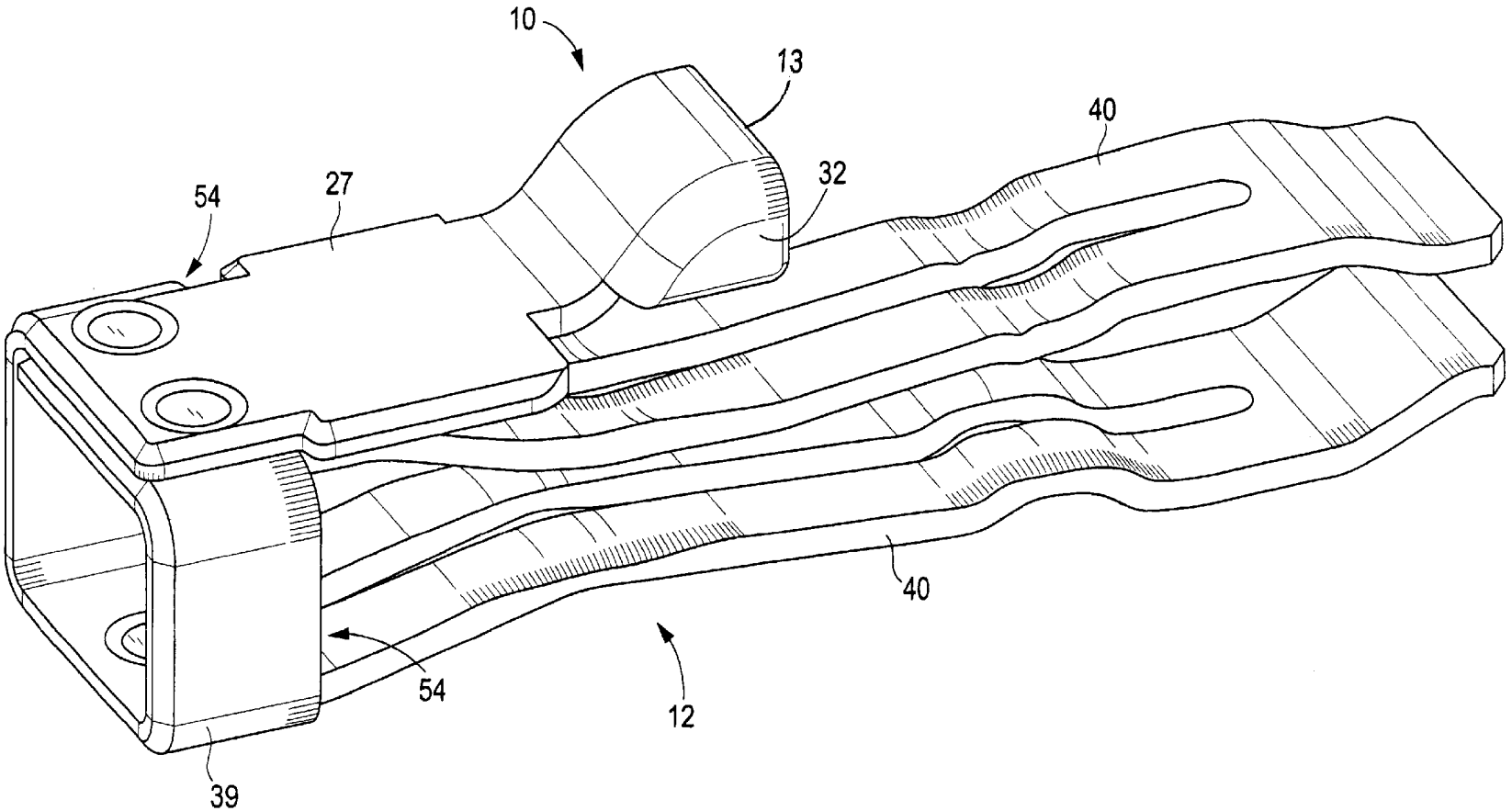
FIG. 5 shows a perspective view of a first embodiment of a contact spring.

FIG. 3 shows the contact 2 constructed from a contact positioner 11 and a contact spring 12. The contact spring 12 is best shown in FIGS. 3 and 5. At the front end, the contact spring 12 has a contact opening 25 surrounded by an opening frame 39. The frame 39 has inner connecting faces 54 at two opposing lateral part frame portions. The lower side of the frame 39 is preferably constructed as a flat face. On the upper and lower side of the frame 39 extend respective double contact arms 40. Each contact arm 40 is symmetrical with respect to a mirror axis arranged between the contact arms 40. The contact arms 40 have an advantageous wave-like structure for contacting contact pins. A first surface region 27 is integrally formed with a sloped guide face 10 on the upper side of the opening frame 39 in the form of a plate. The guide face 10 preferably passes integrally into a curved lateral face 32. Formation of an edge in the right-hand lateral region of the guide face 10 is avoided in this manner. The lateral face 32 is preferably formed by a bending and/or stamping process from a flat plate. The guide face 10 adjoins with a peripheral region 29.

Arranged opposite of the curved lateral face 32, the guide face 10 has a guide plate 28. The guide plate 28 has a second peripheral region 30 substantially adapted to the lateral contour of the guide face 10 and preferably arranged at the same height as the guide face 10.

Preferably arranged transversely to the contact 2 is a first cover 19. The first cover 19 and the guide plate 28 are preferably integral, and the first cover 19 passes via a bend into the guide plate 28. The first cover 19 has a third peripheral region 47 arranged approximately at the same height as the upper side of the region of the guide face 10 adjoining the first cover 19. The first cover 19 preferably has the same width as the guide face 10 such that the guide face 10 is covered over its entire width by the first cover 19. The first cover 19 has an end region arranged opposite from the guide plate 28 that is preferably rounded in the upper corner region 31.

In a variation of the first embodiment of the contact 2, a second guide plate corresponding to the guide plate 28 which laterally delimits the guide face 10 can be provided instead of the lateral face 32. However, care should be taken in this case that the second guide plate is preferably also covered by the first cover 19 and thus the lateral edge of the second guide plate does not come into contact with the seal 4 when the contact 2 is withdrawn from the housing 1.

A second surface region 33, preferably arranged at the same height as the first surface region 27, adjoins the locking element 5. The second surface region 33 is preferably integral with a first lateral face 34 of the contact positioner 11 and is achieved by appropriate bending. A leading edge region 35 of the second surface region 33 is preferably covered by a second cover 20. The second cover 20 is integrally formed with a second lateral face 48 of the contact positioner 11 by appropriate bending. The second cover 20 preferably extends transversely over the entire width of the contact 2. The edge region 35 is also covered in this manner and damage to the seal 4 even by the edge region 35 during withdrawal from the housing 1 is reliably avoided.

Figure 9:
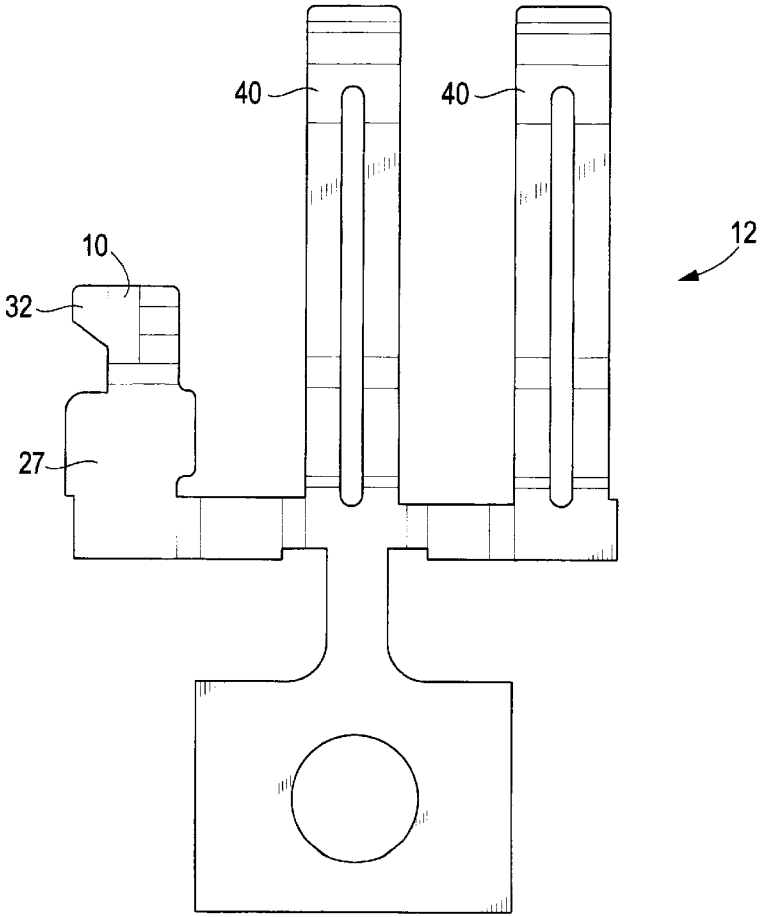
FIG. 9 shows a perspective view of a blank of a contact spring of the first embodiment punched from a plate.
Figure 11:
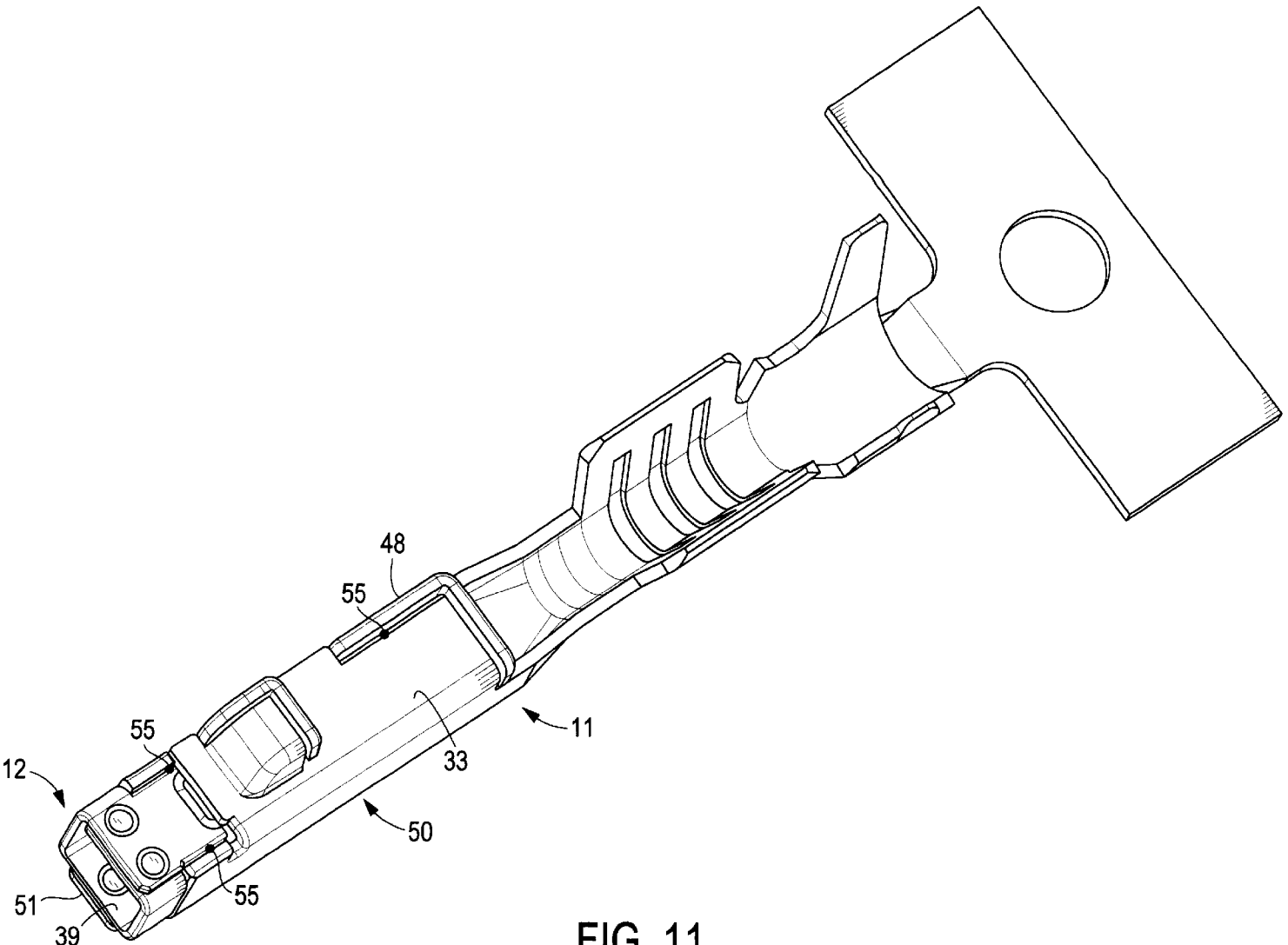
FIG. 11 shows a perspective view of a second embodiment of a contact.

FIG. 9 shows a schematic view of a blank of a contact spring 12 that is punched from a plate by a cutting die. The blank shows the shape of the contact arm 40, the first surface region 27, and the guide face 10 and the lateral face region 32. The lateral face 32 is integrally formed with the guide face 10. After punching the blank of FIG. 9 the contact spring 12 is obtained in the shape according to FIG. 5 or 7 by appropriate bending processes.

Figure 4:
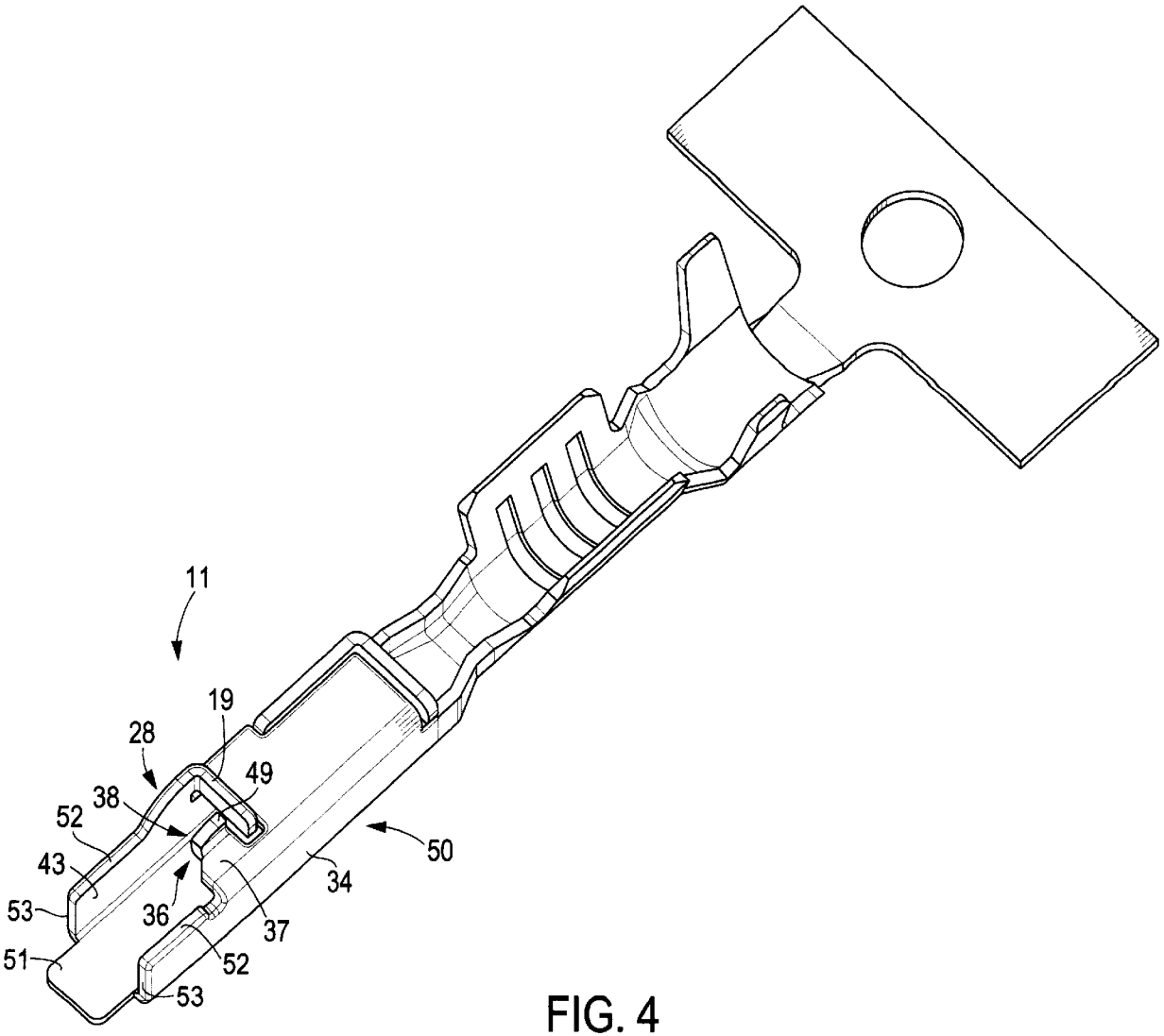
FIG. 4 shows a perspective view of a first embodiment of a contact positioner.

FIGS. 3 and 4 show the contact positioner 11 of the contact 2. FIG. 4 clearly shows the integral construction of the guide plate 28 with the first cover 19 via a bend. The first cover 19 has fixed height so the lower edge of the first cover 19 preferably extends up to the surface of the second surface region 33. A support 36 is formed integrally with the first lateral face 34 of the contact positioner 11. The support 36 is guided upwards via a first bend into a connecting face 37 in the direction of the guide plate 28 and in a second bend into a support plate 38. The support plate 38 has an upper peripheral region 49 preferably constructed at least partially so as to correspond with the contour of the guide face 10. Support for the guide face 10 is provided owing to the arrangement of the support 36. Support for the guide face 10 is ensured in this manner so that the guide face 10 can be manufactured from an elastic material and/or from a thin material. If the contact 2 is pushed through the opening 18 of the seal 4, the seal 4 presses on the guide face 10. The pressure of the seal 4 is absorbed by the support 36 to stabilise the guide face 10.

The contact positioner 11 has a receiving housing 50 having a substantially rectangular shape for receiving the contact spring 12. A lower lateral face 51 projects a predetermined length from the front of the receiving housing 50, with respect to the first and second lateral face 34, 43. In the front region, the receiving housing 50 is open opposite the lower lateral face 51.

The first and second lateral faces 34, 43 have support edges 52 in the open region of the receiving housing 50. The support edges 52 form bearing faces for the first surface region 27 of the contact spring 12. The lower lateral face 51 forms a bearing face for a lower side of the frame 39 of the contact spring 12 in the front region. The lower lateral face 51 is formed as at flat face at least in the front region to ensure the lower surface of the frame 39 is supported on the lower lateral face 51. The first and the second lateral faces 34, 43 have connecting faces 53 in the front end region. The connecting faces 53 are constructed substantially perpendicularly to the orientation of the lower lateral faces 51. The connecting faces 53 serve as connecting faces for the inner connecting faces 54 of the opening frame 39.

The contact positioner 11 and the contact spring 12 are preferably rigidly connected to one another. The contact arms 40 are inserted in a contact section 26 of the contact positioner 11 via the contact opening 25. The contact spring 12 is connected to the contact positioner 11 via weld points 55 provided between the first surface region 27 and the first or second lateral faces 34, 43, as best shown in FIG. 4. The inner connecting faces 54 serve for exact connection of the contact spring 12 with the connecting faces 53 of the first and second lateral faces 34, 43 of the receiving housing 50. Precise positioning of the contact spring 12 in the contact positioner 11 is therefore made possible.

Figure 10:
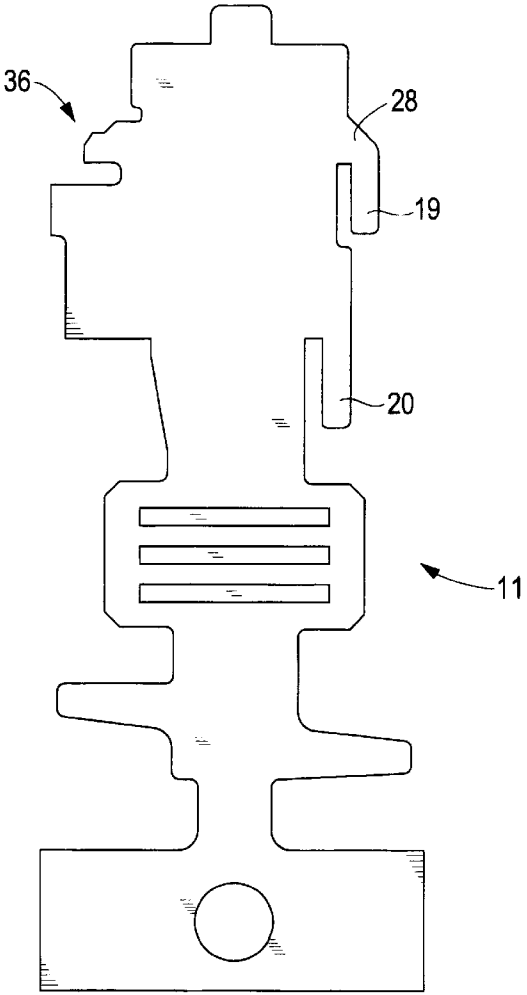
FIG. 10 shows a perspective view of a blank of a contact positioner of the first embodiment punched from a plate.

FIG. 10 shows a blank of the contact positioner 11 of FIG. 4 that is punched from a plate. The contact positioner 11 is then formed by the appropriate bending processes. The integral construction of the first cover 19 and of the second cover 20 with the lateral face 34 can clearly be seen in the blank in FIG. 10. The upper edges of the first and second covers 19, 20 are preferably rounded so the danger of damage to the seal during withdrawal of the contact 2 is further reduced. The construction of the support 36 can also be seen. In the construction of a second holder 41 according to FIG. 6 the cutting die is to be constructed in an accordingly unaltered manner.

Figure 6:
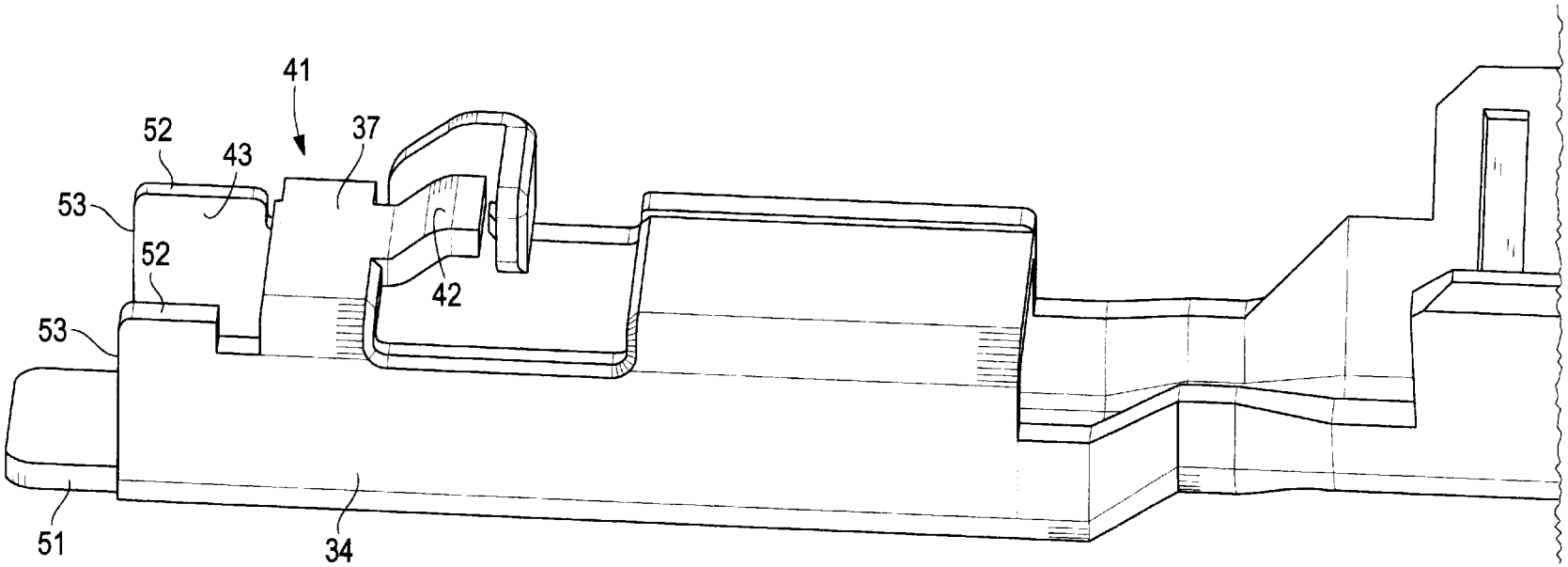
FIG. 6 shows a perspective view of a variation of the first embodiment of the contact positioner.

In a variation of the first embodiment of the contact positioner 11 of FIG. 4, the contact positioner 11 can also be formed as in FIG. 6. The contact positioner 11 in FIG. 6 has a second support 41. The second support 41 passes via a first bend from a lateral face 34 into a first connecting face 37. A second support plate 42 is formed on a transverse side of the first connecting face 37 and is connected via a second bend to the first connecting face 37. The second support plate 42 is positioned a predetermined distance from the first cover 19 and preferably has the same contour as the guide face 10. Owing to the embodiment of the second support plate 42 the contact face 10 is supported over a greater area then when the support 36 is constructed with the support plate 38. Improved spring mounting of the guide face 10 is therefore ensured. The first connecting face 37 is preferably guided to the opposing second lateral face 43. The first connecting face 37 rests on an upper peripheral region of the second lateral face 43. Consequently, the position of the first connecting face 37 is precisely fixed.

Figure 7A:
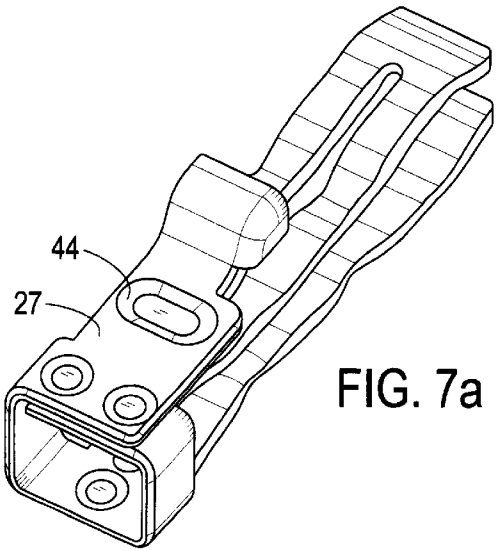
FIG. 7 shows a perspective view of a variation of the first embodiment of the contact spring with a spacer.
Figure 7B:
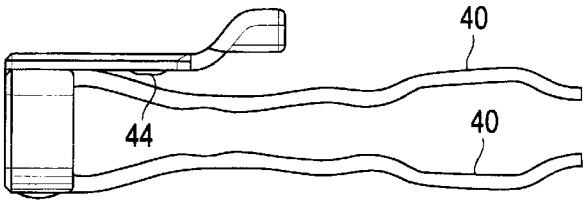

FIG. 7*a* shows a perspective view of a preferred variation of the first embodiment of the contact spring 12 wherein the contact spring 12 has an impression 44 in the first surface region 27. The impression 44 serves as a spacing element for the upper contact arm 40 and is best seen in FIG. 7*b*. Owing to the arrangement of the impression 44, overstretching of the upper contact arm 40 is avoided.

Figure 8A:
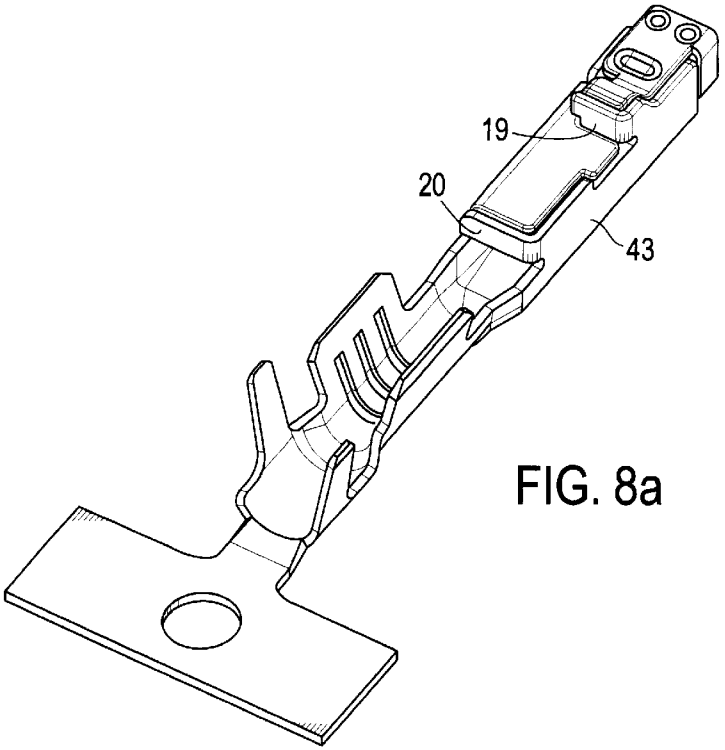
FIG. 8 shows a cross-section through the variation of the first embodiment of the contact.
Figure 8B:
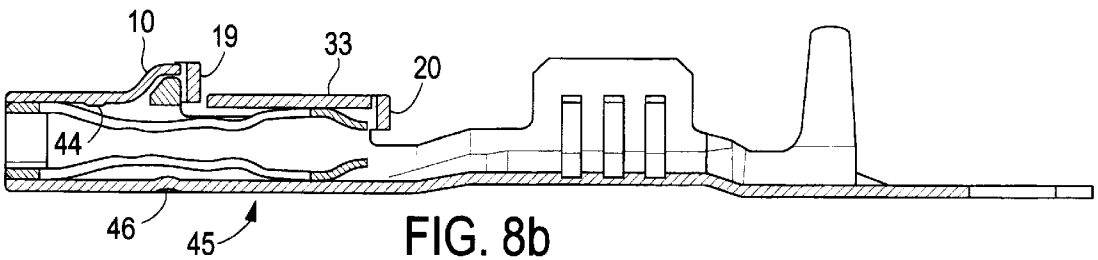

FIG. 8*a* shows a perspective view of the contact 2 with a contact spring 12 according to the embodiment of FIG. 7*a*. In this embodiment the integral construction of the first and second cover 19, 20 with the second lateral face 43 can also be seen. FIG. 8*b* shows a cross-section through the contact 2 of FIG. 8*a*. Here the contact positioner 11 preferably comprises a notch 46 at a lower side 45 that prevents overstretch of the lower contact arm 40. As shown, the upper edge of the first cover 19 is preferably arranged at the same height as the upper edge of the guide face 10. In this manner the leading peripheral region of the guide face 10 is reliably covered by the first cover 19. It can clearly be seen from FIG. 8*b* that the upper edge of the second cover 20 is preferably arranged at the same height as the surface of the second surface region 33. The leading peripheral region of the second surface region 33 is reliably covered by the second cover 20 in this manner.

The insertion of the contact 2 into the plug housing 1 will now be described in greater detail with reference to FIGS. 1 and 2. During production of the plug the seal 4 is inserted in the corresponding seal space of the housing 1. Before the retaining part 16 is positioned onto the front face of the housing 1, the contact 2, to which the electrical conductor 9 is already attached, is subsequently pushed through the insertion opening 3 and the opening 18 into the receiving space 14. To avoid damage to the seal 4 during insertion of the contact 2, the sloped guide face 10 of the locking element 5 widens the opening 18 to receive the contact 2.

When the contact 2 reaches the connecting position in the receiving space 14, the retaining edge 6 is pushed outwards by the guide face 10 until the guide face 10 has moved past the retaining edge 6. The retaining edge 6 subsequently returns to its resting position shown in FIG. 1. The retaining part 16 is positioned on the housing 1 such that the retaining edge 6 is retained in its resting position. The retaining part 16 rests on the web 15 on which the retaining edge 6 is formed and holds the retaining edge 6 in a locking position, as shown in FIG. 1. In the locking position the locking element 5 is limited on the locking side 13 by the retaining edge 6 from movement in the direction of the insertion opening 3.

To withdraw the contact 2 from the housing, for example, to change the electrical conductor 9, the retaining part 16 is removed from the housing 1. The contact 2 is withdrawn from the housing 1 in the direction of the insertion opening 3 via the electrical conductor 9. As the contact 2 is withdrawn, the retaining edge 6 is bent outwards by the locking element 5 without damage to the retaining edge 6 owing to the elastic construction of the web 15.

The contact 2 is withdrawn through the opening 18 in the direction of the insertion opening 3. As the contact 2 is withdrawn through the opening 18 of the seal 4, the first and second steps 23, 24 contact the opening 18. During withdrawal the seal 4 initially rests on the second cover 20 and is pushed upwards by the second cover 20 and then slides on the second surface region 33. When the first cover 19 reaches the seal 4, the seal 4 is lifted further upwards by the first cover 19 and lifted via the peripheral region of the guide face 10 onto the surface of the guide face 10. The contact 2 can thus be moved through the opening 18 of the seal 4 with minimal damage. Owing to the arrangement of the first and/or a second covers 19, 20 damage to the seal 4 in the region of the opening 18 is therefore avoided.

The first and second covers 19, 20 are preferably formed over the entire width of the locking side 13 of the locking element 5. Therefore, in contrast to the known prior art, the seal 4 is raised over the entire width of the locking element 5 when the contact 2 is withdrawn from the housing 1. Consequently, the seal 4 is protected in the entire peripheral region of the locking element 5 from damage by the peripheral region of the locking element 5.

A simple construction of the first and second covers 19, 20 is achieved in that the covers 19, 20, proceeding from a lateral wall region, are aligned via a bend along the locking side of the locking element 5. Simple and inexpensive production of the covers 19, 20 is also made possible in this manner.

FIGS. 11 through 15 show a second embodiment of the contact 2 comprising a contact positioner 11 and a contact spring 12. In contrast to the first embodiments of FIGS. 1 through 10, the guide face 10 in the second embodiment is not integrally formed as part of the contact spring, but is integrally formed as part of the contact positioner 11.

Figure 12:
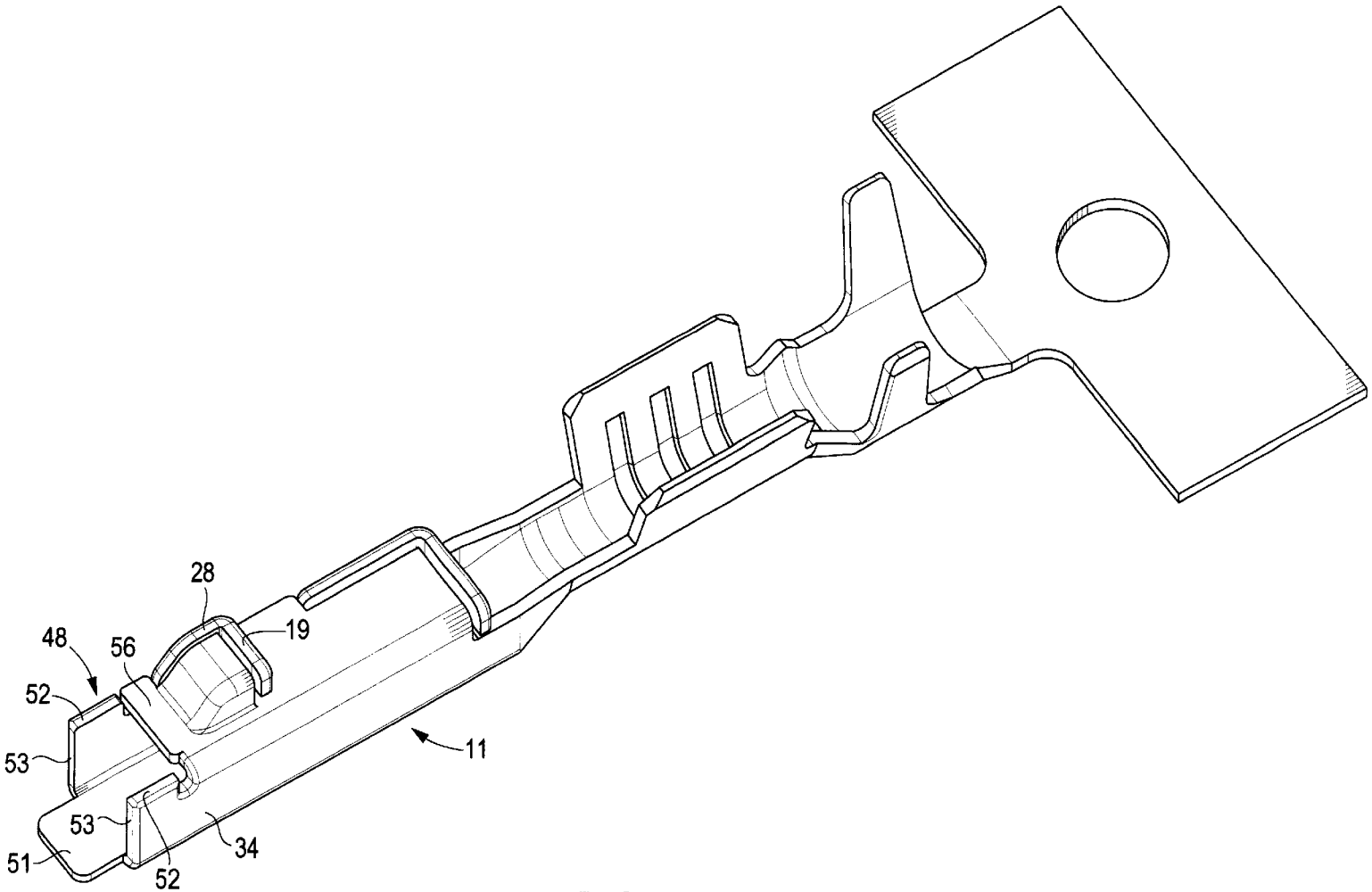
FIG. 12 shows a perspective view of a second embodiment of a contact positioner.

FIG. 12 shows the second embodiment of the contact positioner 11 having the guide face 10. The guide face 10 is integrally formed with the first lateral face 34. The first lateral face 34 is integrally formed with a transverse web 56. The transverse web 56 is guided from the first lateral face 34 transversely via the receiving space up to the opposing second lateral face 48 and rests on the second lateral face 48. Proximate the transverse web 56, the guide face 10 extends in the longitudinal direction of the contact positioner 11 in the direction of the first cover 19 and is integrally connected to the second lateral face 48.

The second lateral face 48 has a guide plate 28. The upper edge of the guide plate 28 is formed to correspond with the bulging shape of the guide plate 10. The upper edge of the first cover 19 is also preferably arranged at the same height as the upper edge of the end region of the guide face 10 associated with the first cover 19. The lower lateral face 51 projects beyond the first and second lateral faces 34, 48. The first and second lateral faces 34, 48 have support edges 52 and connecting faces 53 arranged at the front.

Figure 13:
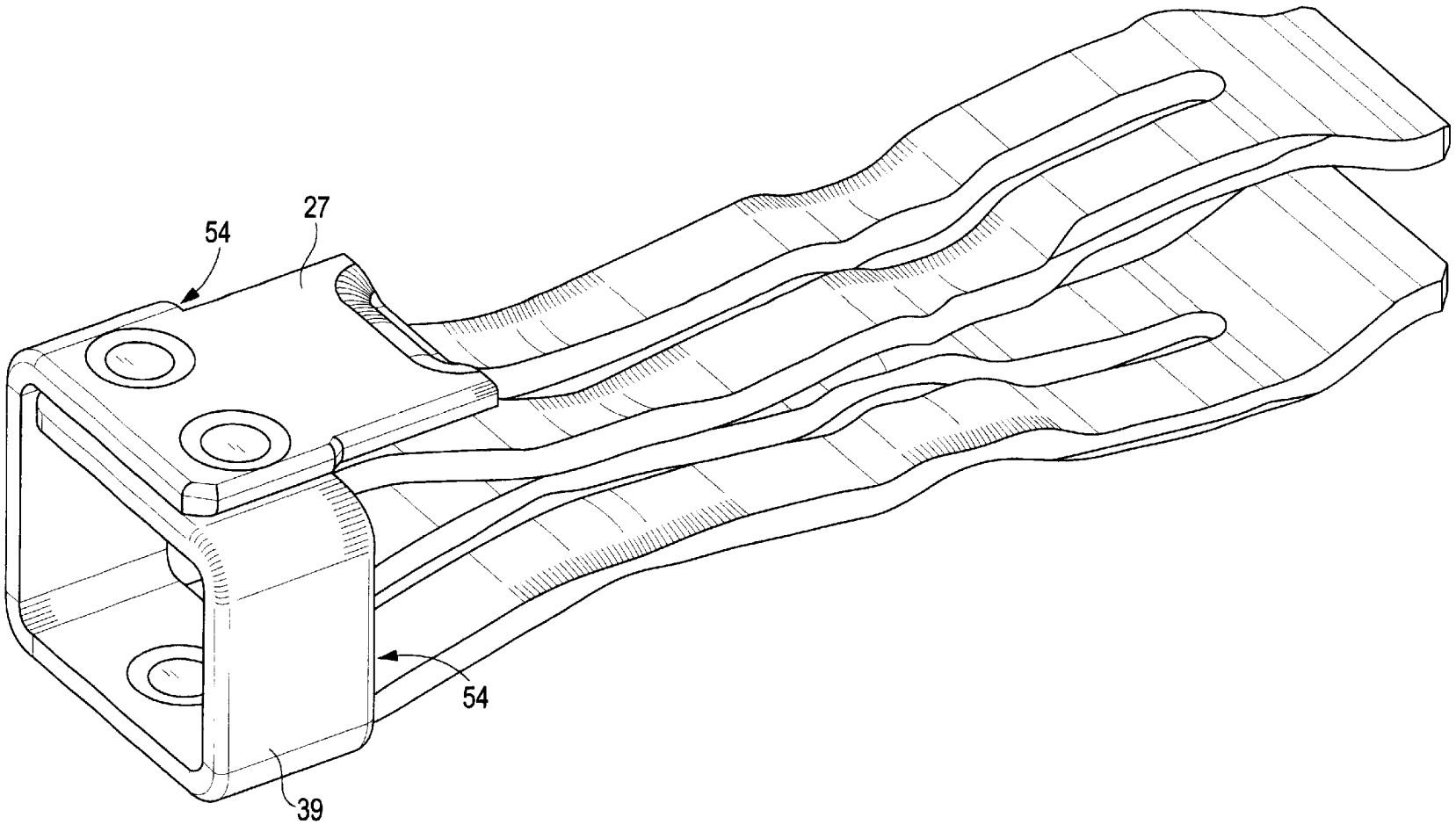
FIG. 13 shows a perspective view of a second embodiment of a contact spring.

FIG. 13 shows the second embodiment of the contact spring 12, which has substantially the same form as the contact spring 12 shown in FIG. 5. The contact spring 12 has a shortened first surface region 27 and does not have a guide face 10. The frame 39 has inner connecting faces 54 positioned at the two opposing lateral frame portions. The first surface region 27 tapers in the direction of the contact positioner 11.

In the assembled state the first surface region 27 is inserted laterally between the bearing edges 52 of the first and second lateral faces 34, 43. The frame 39 rests with its lower side on the lower lateral face 51. The inner connecting faces 54 rest on the connecting faces 53 of the receiving housing 50. A simplified weld joint is therefore possible. The contact spring and the contact positioner are welded to one another via weld points 55, the weld points being arranged in the region of the frame 39. In addition, the receiving housing 50 of the contact positioner 11 is also kept in its shape via a weld point 55. Here, the weld point 55 is provided between the second surface region 33 and the second lateral face 48. The weld joint is preferably produced by laser welding.

Figure 15:
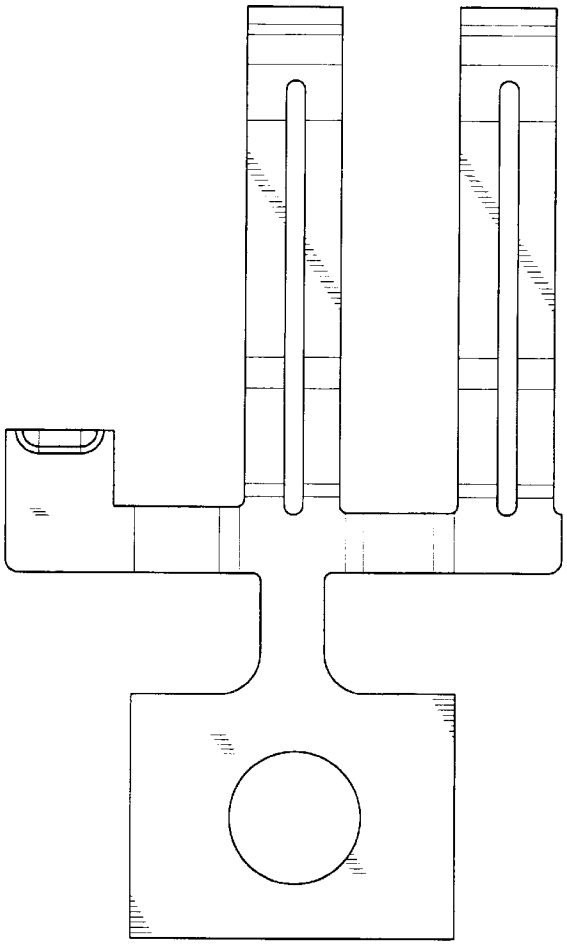
FIG. 15 shows a perspective view of a blank of the second embodiment of the contact spring.
Figure 14:
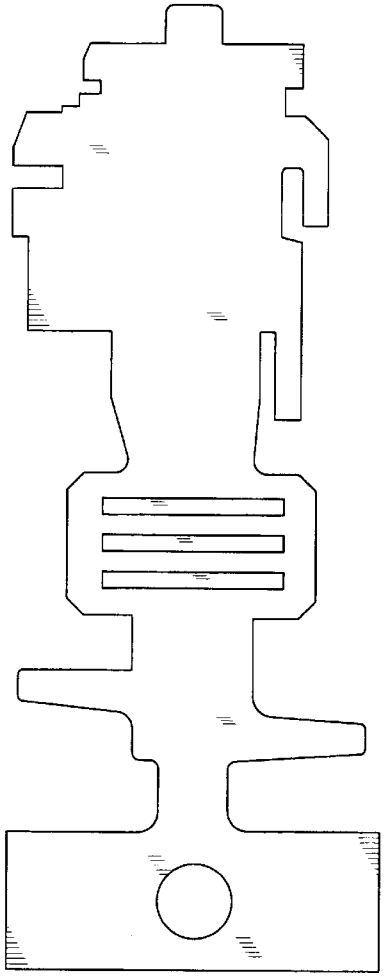
FIG. 14 shows a perspective view of a blank of the second embodiment of the contact positioner.

FIG. 14 shows a blank of the second embodiment of the contact positioner 11 of FIG. 12 in which the second contact positioner 11 is cut, punched or stamped from a plate. FIG. 15 shows a blank of the second contact spring 12 of FIG. 13 in which the contact spring 12 is cut, punched or stamped from a plate. The contact positioner 11 and the contact spring 12 are produced from the blanks by appropriate bending and/or curving processes.

A considerable advantage of the contact according to the first and second embodiments of the invention is that a cover is associated with the locking element in the direction of withdraw, and prevents contact of an edge region of the locking element, arranged on the locking side, with a seal. A locking element with a surface which is as closed as possible is therefore obtained. The surface of the locking element is preferably completely closed. This ensures that when the contact is pushed out of the housing the seal is raised by the cover and consequently damage to the seal by the edge region of the locking element is reliably avoided.

I claim:

1. A contact comprising:

a termination section for connection of an electrical conductor;

a contact section for contacting a complementary contact;

a locking element having a guide face with a locking side for maintaining the contact in a housing; and a separate cover that covers the locking side to form a closed surface.

2. The contact of claim 1, further comprising a guide plate that covers a lateral side of the guide face.

3. The contact of claim 2, wherein the cover is integrally formed with the guide plate that covers the lateral side.

4. A contact comprising:

a contact spring having resilient contacts;

a contact positioner that receives the contact spring for connection to an electrical conductor;

a locking element having a guide face with a locking side for maintaining the contact in a housing; and a cover that covers the entire locking side to form a closed surface.

5. The contact of claim 4, further comprising a guide plate that covers a lateral side of the guide face.

6. The contact of claim 5, wherein the cover is integrally formed with the guide plate that covers the lateral side.

7. The contact of claim 4, further comprising a support to maintain the guide face at a fixed height.

8. The contact of claim 4, further comprising a stop element for limiting the movement of the contact arms.

9. The contact of claim 8, wherein the stop element is formed on the locking element.

10. The contact of claim 4, wherein the contacts are covered by a plate having an edge that is covered by a second cover.

11. The contact of claim 4, wherein the cover is integrally formed on the contact positioner.

12. The contact of claim 4, wherein the contact spring has a frame rigidly connected to the contact positioner by welding.

13. The contact of claim 4, wherein the locking element is integrally formed with the contact spring.

14. The contact of claim 13, wherein the contact spring is formed from a plate.

15. The contact of claim 4, wherein the locking element is integrally formed with the contact positioner.

16. The contact of claim 15, wherein the contact positioner is formed from a plate.

17. The contact of claim 4, wherein the cover has a rounded top surface.

18. A contact comprising:

a contact spring having resilient contacts;

a contact positioner that receives the contact spring for connection to an electrical conductor;

a locking element having a guide face with a locking side for maintaining the contact in a housing; and a cover that covers the locking side to form a closed surface that enlarges a seal opening of the housing to prevent the seal from damage by the locking element when the contact is inserted and withdrawn from the housing.

19. The contact of claim 18, wherein the guide face has a lateral side having a guide plate that covers the lateral side to form a closed surface that enlarges a seal opening of the housing to prevent the seal from damage by the locking element when the contact is inserted and withdrawn from the housing.

20. The contact of claim 19, wherein the contacts are covered by a plate having an edge that is covered by a second cover.

* * * * *